US007681375B2

(12) United States Patent
Wipf et al.

(10) Patent No.: US 7,681,375 B2
(45) Date of Patent: Mar. 23, 2010

(54) PACKAGING MACHINE FOR PRODUCING BAG PACKAGES, AND BAG PACKAGE

(75) Inventors: Alfred Wipf, Jestetten (DE); Thomas Reissig, Nürnberg (DE); Daniel Moreno Horn, Heidelberg (DE)

(73) Assignee: Robert Bosch GmbH, Stuttgart (DE)

( * ) Notice: Subject to any disclaimer, the term of this patent is extended or adjusted under 35 U.S.C. 154(b) by 496 days.

(21) Appl. No.: 11/587,209

(22) PCT Filed: Apr. 1, 2005

(86) PCT No.: PCT/DE2005/000585

§ 371 (c)(1),
(2), (4) Date: Oct. 23, 2006

(87) PCT Pub. No.: WO2005/105582

PCT Pub. Date: Nov. 10, 2005

(65) Prior Publication Data

US 2007/0220838 A1 Sep. 27, 2007

(30) Foreign Application Priority Data

Apr. 30, 2004 (DE) ..... 10 2004 021 769

(51) Int. Cl.
*B65B 61/18* (2006.01)

(52) U.S. Cl. ..... 53/412; 53/419; 53/133.8; 53/137.2

(58) Field of Classification Search ..... 53/412, 53/419, 133.5, 133.6, 133.7, 133.8, 136.3, 53/137.2
See application file for complete search history.

(56) References Cited

U.S. PATENT DOCUMENTS

| | | | | | |
|---|---|---|---|---|---|
| 2,079,328 | A | * | 5/1937 | McBean | 53/412 |
| 2,114,804 | A | * | 4/1938 | Malocsay | 53/412 |
| 2,130,729 | A | * | 9/1938 | Burns | 53/133.6 |
| 2,296,830 | A | | 9/1942 | Beals | |
| 3,566,752 | A | * | 3/1971 | Dreher | 53/412 |
| 3,834,113 | A | * | 9/1974 | Howe et al. | 53/412 |
| 3,940,904 | A | * | 3/1976 | McGuire et al. | 53/412 |
| 4,294,360 | A | | 10/1981 | LeVeen | |
| 5,983,594 | A | * | 11/1999 | Forman | 53/133.5 |

(Continued)

FOREIGN PATENT DOCUMENTS

DE 196 24 042 A1 12/1997

(Continued)

*Primary Examiner*—Louis K Huynh
(74) *Attorney, Agent, or Firm*—Ronald E. Greigg

(57) ABSTRACT

A horizontal bag-making machine having a packaging material delivery unit, a product delivery unit, and a folding, sealing, and separating unit for folding the packaging material into a tube, sealing the folded packaging material in the directions transverse and parallel to a conveying direction and for cutting the packaging material into individual bag packages also has a tear-open assistance unit located in the conveying direction between the product delivery unit and the folding, sealing, and separating unit. The tear-open assistance unit produces an overlap of material in the separation region, the overlap of material extending at least approximately transversely to the conveying direction of the packaging material, and releasably fixes the overlap of material in the separation region. The bag packages produced in this way are easy to open yet are still in accordance with stringent hygiene regulations.

8 Claims, 15 Drawing Sheets

U.S. PATENT DOCUMENTS

| | | | | |
|---|---|---|---|---|
| 6,865,860 | B2 * | 3/2005 | Arakawa et al. | 53/133.8 |
| 6,910,995 | B2 * | 6/2005 | Schneider et al. | 53/133.8 |
| 2004/0011677 | A1 | 1/2004 | Arakawa et al. | |

FOREIGN PATENT DOCUMENTS

| | | | |
|---|---|---|---|
| DE | 297 18 278 | U1 | 2/1998 |
| EP | 1 375 380 | A1 | 1/2004 |
| EP | 0 912 400 | B2 | 8/2005 |
| WO | WO 2005/105582 | A1 | 11/2005 |

* cited by examiner

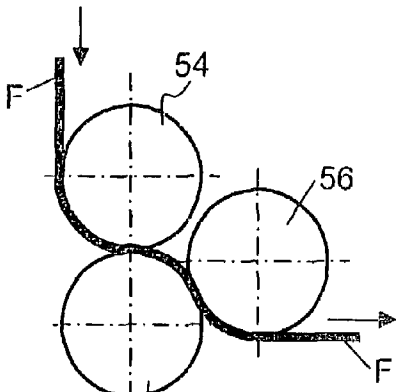
Fig. 11a
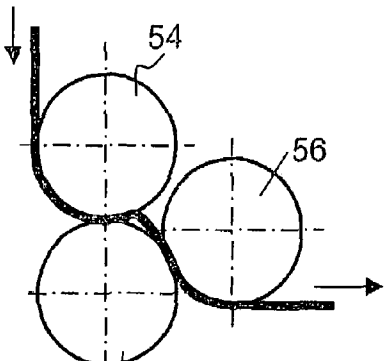
Fig. 11b
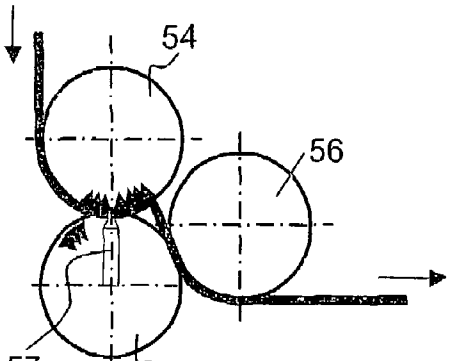
Fig. 11c
Fig. 11d
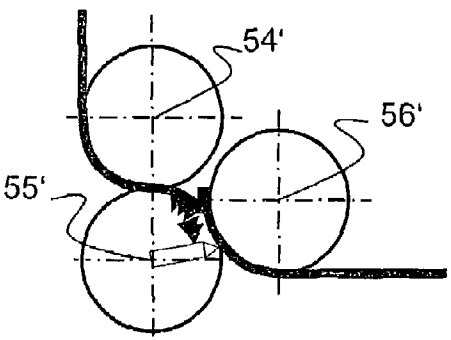
Fig. 11e
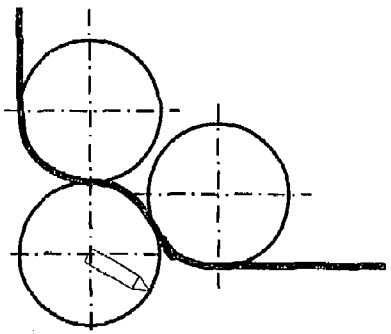
Fig. 11f

PACKAGING MACHINE FOR PRODUCING BAG PACKAGES, AND BAG PACKAGE

CROSS-REFERENCE TO RELATED APPLICATIONS

This application is a 35 USC 371 application of PCT/DE 2005/000585 filed on Apr. 1, 2005.

BACKGROUND OF THE INVENTION

1. Prior-Art Field of the Invention

The invention relates to an improved packaging machine for producing bag packages, to a bag package, and to an improved method for producing a bag package;

2. Description of the Prior Art

U.S. Pat. No. 5,411,202 discloses a package with two transverse sealing seams and one longitudinal sealing seam extending perpendicular to them. The package has a tear strip, which is applied to the packaging material parallel to the two transverse sealing seams. To assure that the package will in fact tear at the tear strip, it is provided with tear notches in the region of the protruding tab of the longitudinal seal.

German Patent Disclosure DE-A 44 26 760 discloses a package with a tear thread that extends parallel to the transverse sealing seams and adheres firmly to the packaging material. The tear thread that must be additionally attached makes production more difficult and thus increases the production costs. If the packaging material is furthermore relatively thick, it is often not possible to tear open the package at this point.

U.S. Pat. No. 4,589,553 describes a package for food products of elongated shape, which is provided on one short end with a holder in which a transverse seal and a region of the package adjacent to it are held. Just above the holder, the package is provided with an encompassing perforation strip that extends parallel to the transverse sealing seam. If the holder is held in one hand and if the diametrically opposite transverse seal is pulled, the package tears at the transverse sealing seam, and the food product can be held like a popsicle on a stick and eaten.

German Utility Model DE-A 202 12 252 U shows a flat bag package with a longitudinal sealing seam and with transverse sealing seams extending parallel to it; the longitudinal sealing seam is embodied as a tearing aid.

German Patent Disclosure DE-A 43 11 841 describes an envelope for notices, with an opening line that extends approximately through its middle. The opening line is embodied in zigzag form.

These packages with rated breaking points have the disadvantage that they often fail to meet the stringent regulations for hygiene in the food field, so that the package must be additionally encased in a further protective film. This increases the packaging costs and produces more waste than would be necessary.

European Patent Disclosure EP-A 0 785 900 discloses an apparatus for folding accordion folded information sheets.

European Patent Disclosure EP-A 0 202 115 also shows a folded apparatus for producing products that are folded crosswise at least twice.

SUMMARY AND ADVANTAGES OF THE INVENTION

It is therefore an object of the invention to create a packaging machine and a method for producing bag packages that permit simple production of bag packages with a tearing aid. A further object of the invention is to create a bag package that is easy to open.

These objects are attained by a packaging machine, a bag package, and a method of producing a bag package which meets stringent hygiene requirements. It is also suitable for packaging different products and can be securely opened. The opening mechanism is simple and easy for the user to understand, even if different products or goods are contained or if the package is made from different materials.

One advantage of the package or bag according to the invention is that the product is not touched at any time during the opening process. The process of tearing the package open can also be done in a controlled way, and the package tears apart into two defined parts.

In packages that now have to be newly provided with this kind of tearing aid, the label need not be changed, since the package surface remains the same, and the existing pressure units of the packaging machine can be operated with the existing operating parameters.

It is also advantageous that the known packaging materials can be used, and no additional material with different properties, such as a stable tear strip, has to be used.

A further advantage is that known packaging systems can easily be retrofitted in order to provide the packages with the tearing aid according to the invention. Only one additional unit is necessary, which is preferably located between the delivery unit for the packaging material and its folding and sealing unit.

BRIEF DESCRIPTION OF THE DRAWINGS

Exemplary embodiments of the invention are described in further detail below, in conjunction with the drawings, in which:

FIGS. 11*a* through 11*f*, a detail of the tear-open assistance unit of FIG. 8 in six steps in a third variant;

DESCRIPTION OF THE PREFERRED EMBODIMENTS

Figure 1:
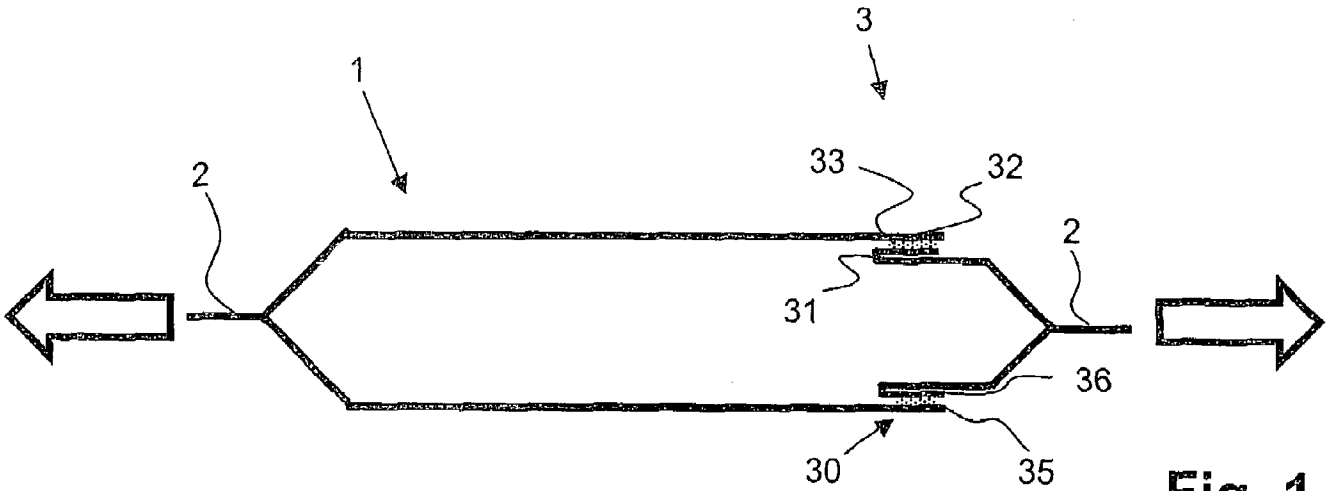
FIG. 1 is a basic sketch of a package according to the invention, in a first exemplary embodiment.

FIG. 1 shows a first exemplary embodiment of the package 1 of the invention. The package 1 is a bag package, of the kind that can be produced in particular by a horizontal bag-making machine and serves to package perishable goods, especially foods, such as chocolate bars or cereal bars.

The packaging material of the package 1 typically comprises a one- or multi-layer foil material. However, still other flexible materials can be used as the packaging material. The package 1 has two transverse or end sealing seams 2, extending approximately parallel to one another, and one longitudinal sealing seam, not visible in FIG. 1, extending transversely to the end seams over the entire length of the package 1. These seals are of a permanent kind; that is, typically they can no longer be undone. Instead, the material tears in the immediate vicinity of the seal, or breaks apart into its individual layers.

According to the invention, the package 1 is provided with an encompassing tearing aid 3, which is formed by an overlapping region 30 of the packaging material. The tearing aid 3 or overlapping region 30 extends at least approximately and preferably precisely parallel to the transverse sealing seams 2. In this example, it is formed by a singly folded internal packaging material fold 31, which is connected to an external packaging material edge region 32. The connection can be separated or undone under tensile stress. The connection is preferably an encompassing, undoable sealing seam 33.

Figure 7:
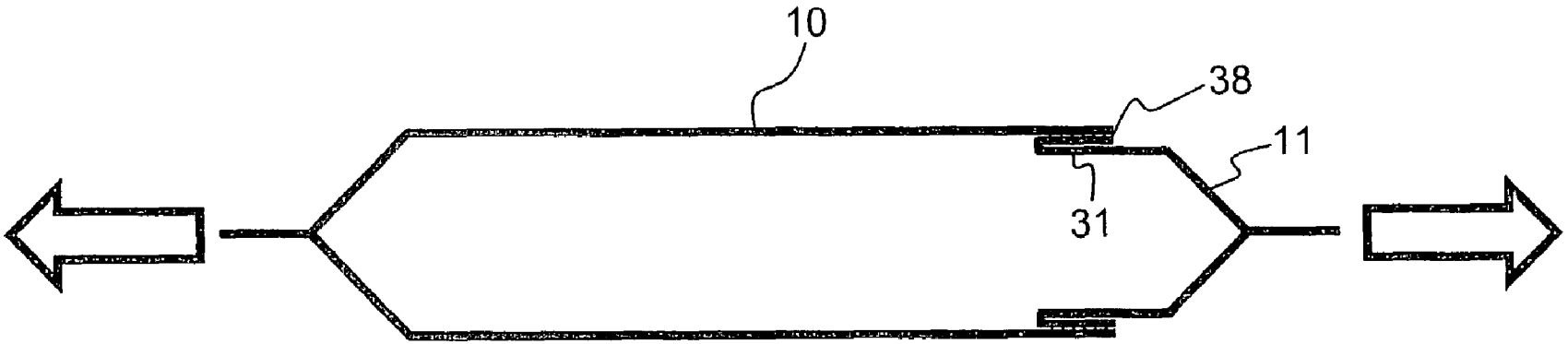
FIG. 7, a basic sketch of a package according to the invention, in a seventh exemplary embodiment.

The packaging material fold 31 can change over, by way of a perforation line 38, into the external packaging material edge region 32, as is shown in FIG. 7. However, as can be seen in FIG. 1, the two regions may also not be joined together except at their separable or undoable sealing seam 33, so that the edge region 32 then has a first edge 35 and the internal packaging material fold 31 has a second edge 36. These two edges 35, 36 rest on one another and are preferably aligned with one another.

Figure 2:
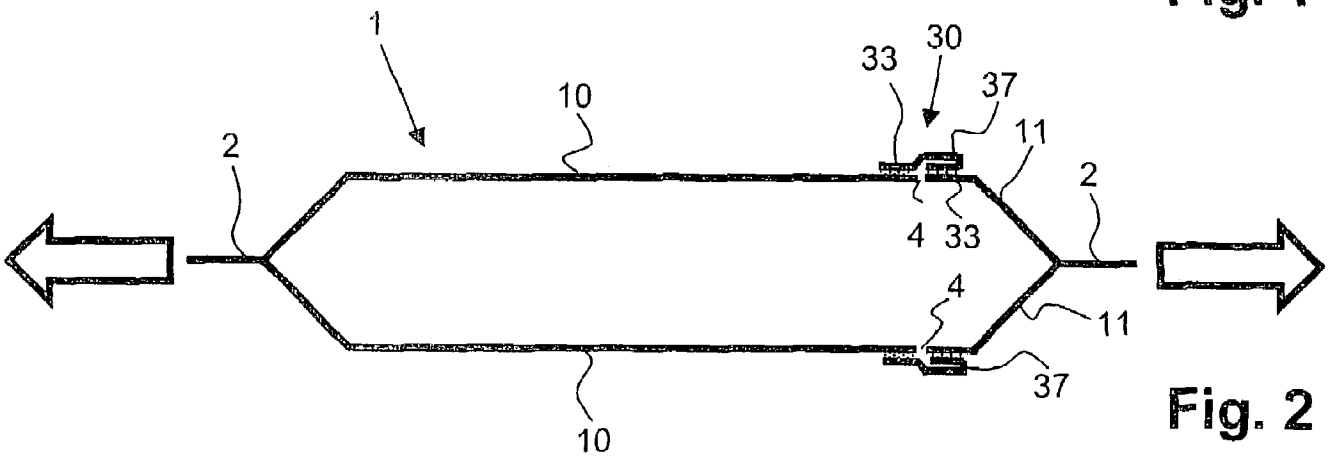
FIG. 2, a basic sketch of a package according to the invention, in a second exemplary embodiment.

In the exemplary embodiment of FIG. 2, the overlapping region 30 is formed by an encompassing folded strip 37. The packaging material has a separation line 4, extending parallel to the transverse sealing seams 2 and extending all the way around the package, which divides the packaging material into a first package region 10 and a second package region 11, which are completely separated from one another via the separation line 4. This separation line or gap 4 is now covered over its entire length by the strip 37. The strip 37 is folded on at least one side. It is furthermore joined detachably, along both long edges, to the first and second package regions 10 and 11, preferably by means of an separable sealing seam 33. This seam can also be undone under tensile stress, for instance by grasping the package 1 at the two transverse sealing seams 2 and pulling the package apart.

Figure 3:
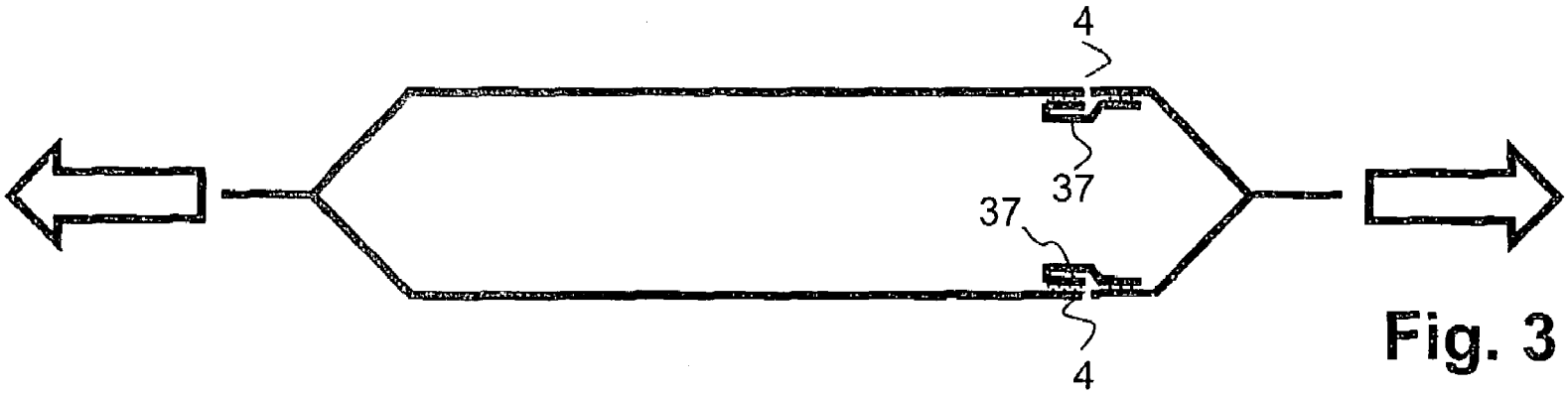
FIG. 3, a basic sketch of a package according to the invention, in a third exemplary embodiment.

The package in FIG. 3 differs from that in FIG. 2 in that the strip 37 is applied not to the outside but to the inside of the package 1. Thanks to the folding of the strip, despite the separation line 4 being located on the outside, a hygienically sufficiently tight closure of the package is assured.

Figure 4:
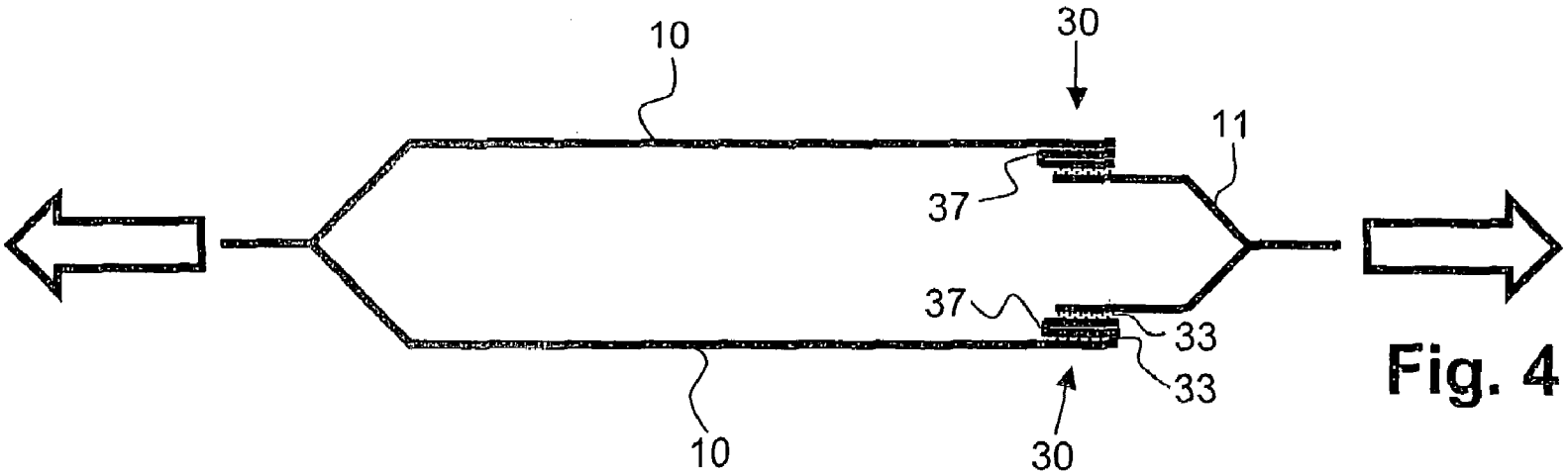
FIG. 4, a basic sketch of a package according to the invention, in a fourth exemplary embodiment.

In the variant in FIG. 4, the first and second package regions 10, 11 are embodied in overlapping fashion. In their overlapping region 30, there is a folded strip 37. This strip 37 can be made by suitably folding and cutting the length of packaging material. However, it can also be introduced as a separate part between these two regions 10, 11. Once again, the strip or band 37 is connected to the first and second package regions 10, 11 by an undoable connection, and in particular two releasable seals 33 each extending around the circumference of the package 1.

Figure 5:
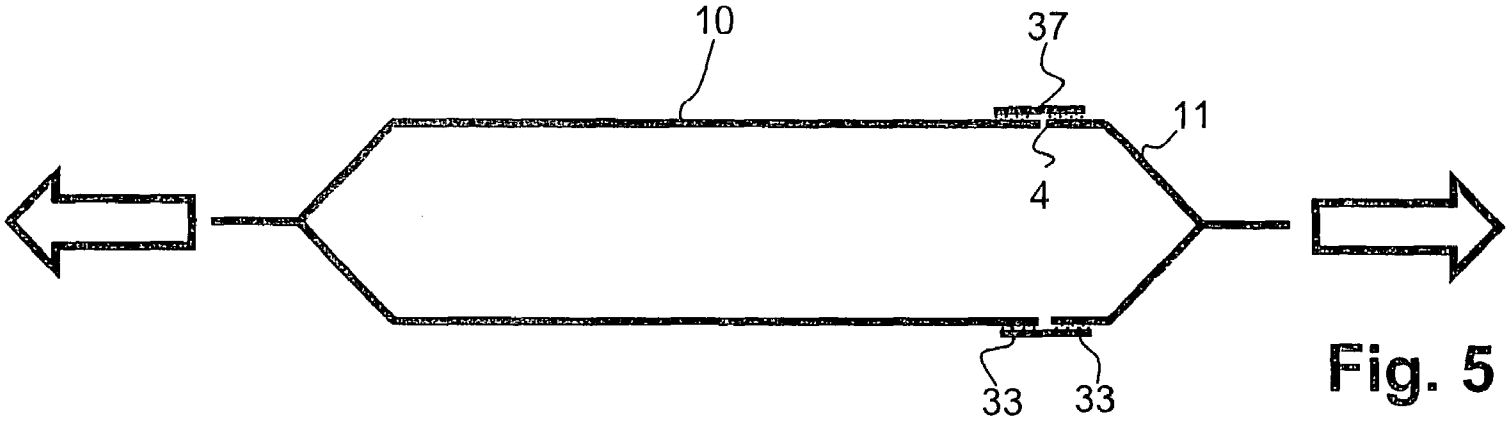
FIG. 5, a basic sketch of a package according to the invention, in a fifth exemplary embodiment.

The embodiment shown in FIG. 5 is again like that of FIG. 2, but here the strip 37 is not folded but instead placed as a single layer over the gap or separation line 4 of the two package regions 10, 11 and joined releasably to them. Once again, releasable sealing seams 33 extending all the way around the circumference of the package 1 and extending to the right and left of the separation line 4 are preferred. However, one of the sealing seams 33 is embodied as weaker than the other, so that the separation occurs intentionally at that point. It is also possible to design only one of the two sealing seams 33 as undoable and to embody the other as a permanent sealing seam.

Figure 6:
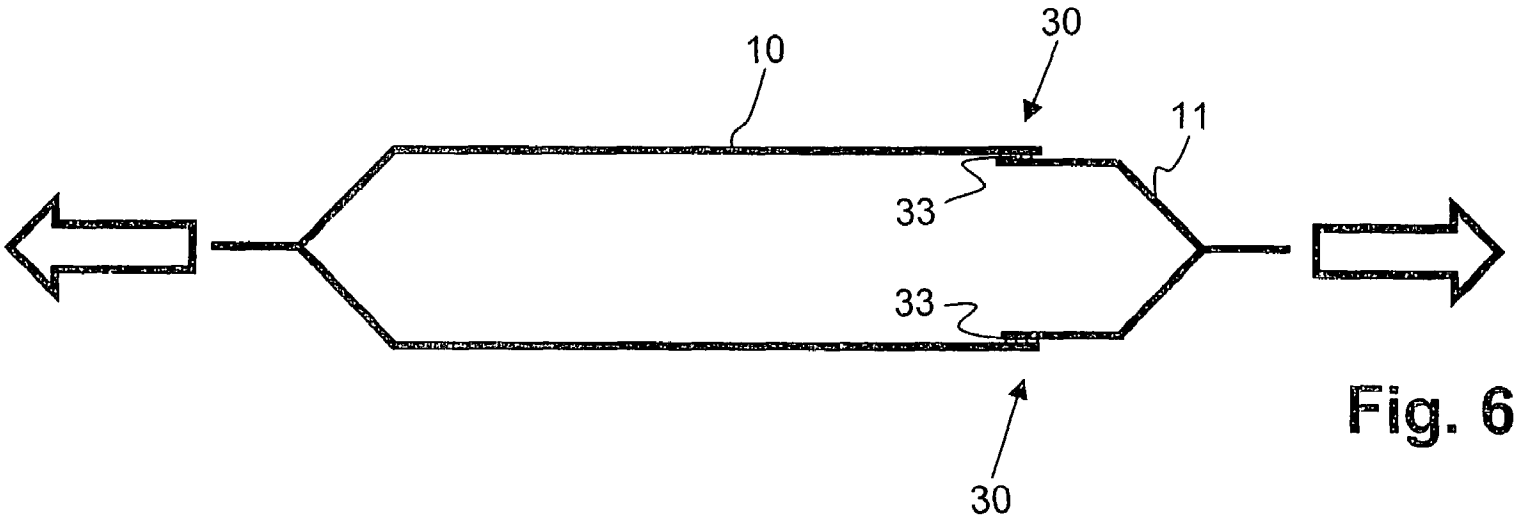
FIG. 6, a basic sketch of a package according to the invention, in a sixth exemplary embodiment.

In the embodiment of FIG. 6, the two package regions 10, 11 overlap one another, as has already been shown in FIG. 4. Here, however, there is no intermediate strip; instead, the two edges of the regions 10, 11 are joined directly to one another, for instance via an undoable sealing seam 33 extending all the way around, or by an adhesive bond.

Figure 8:
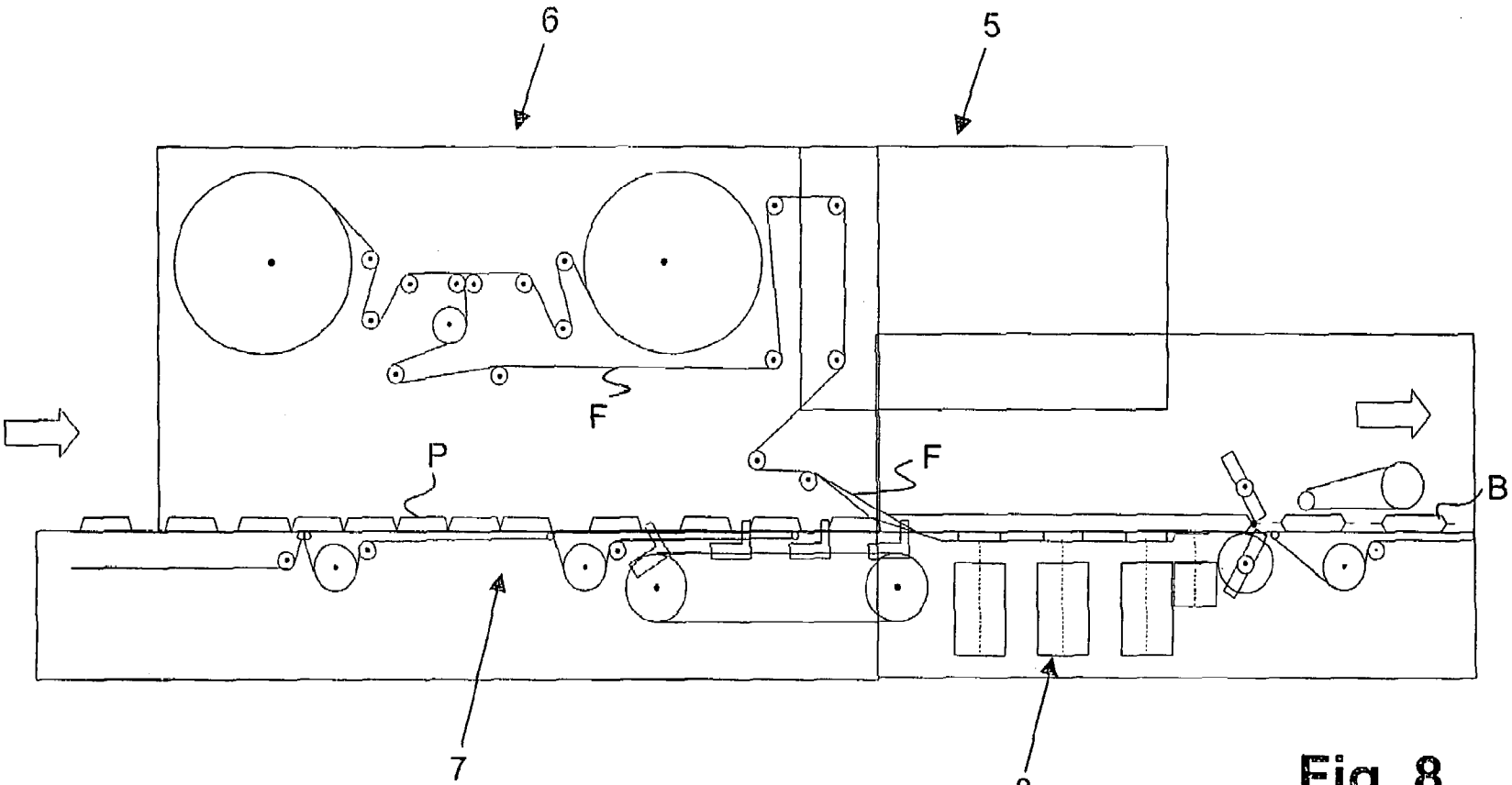
FIG. 8 is a basic sketch of a packaging machine having an integrated tear-open assistance unit according to the invention.

In FIG. 8, a preferred apparatus for producing such bag packages is shown. This is a known kind of packaging machine for making bag packages, in particular a horizontal bag package making machine, which for forming the tearing aid is provided with a tear-open assistance unit 5 of the invention.

The apparatus furthermore has one delivery unit 6 for the packaging material F and one delivery unit 7 for the separate or grouped delivery of products P that are to be packaged. The products P are fed onto the packaging material F and transported onward by it. In a folding, sealing, and separating unit 8, the packaging material F is folded and shaped into a tube of packaging material; individual bags containing the desired number of products are closed by the making of a longitudinal sealing seam and transverse sealing seams and separated from one another and leave this unit in the form of individual bags B for further processing or packaging. Between the packaging material delivery unit 6 and the folding unit 8, the tear-open assistance unit 5 of the invention is now located. This is represented in FIG. 8 by a "black box". How this tear-open assistance unit 5 is effectively designed depends on which of the above-described packaging variants is to be attained.

Figure 9A:
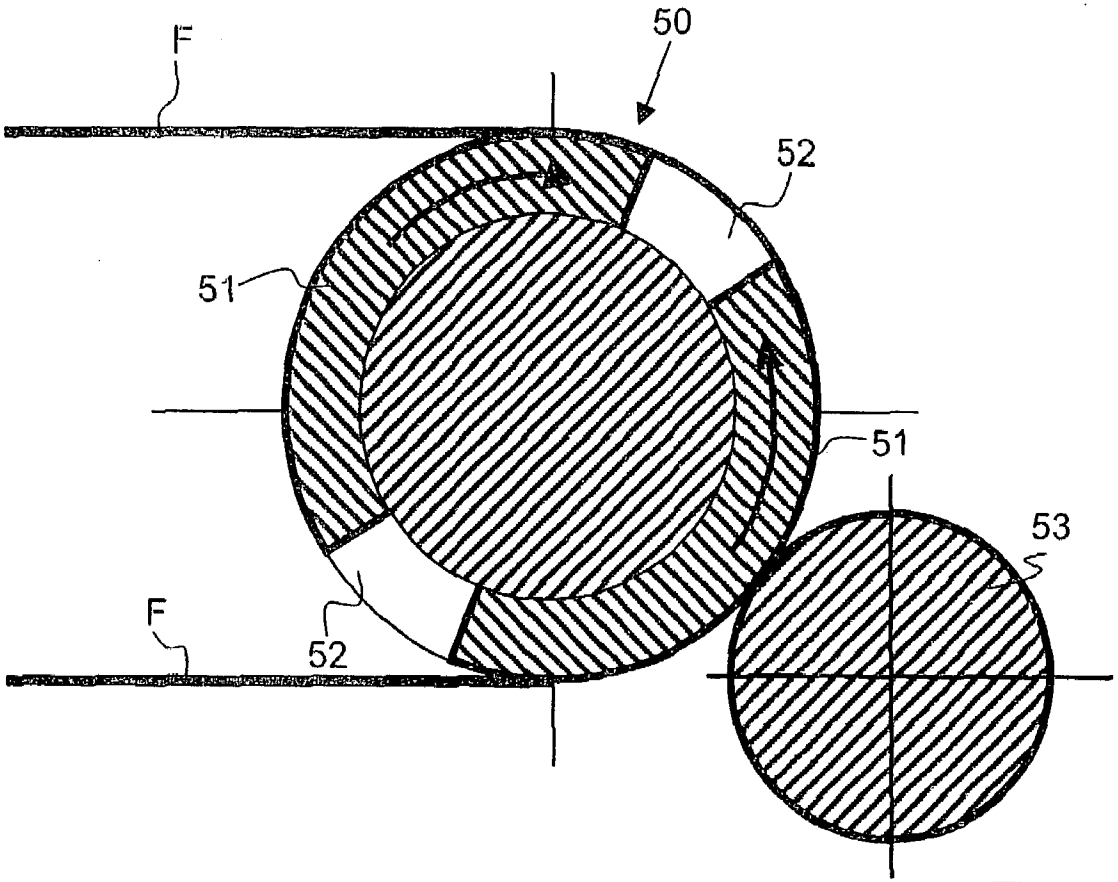
FIG. 9*a*, a detail of the tear-open assistance unit of FIG. 8, in a first variant in a first method step.
Figure 9B:
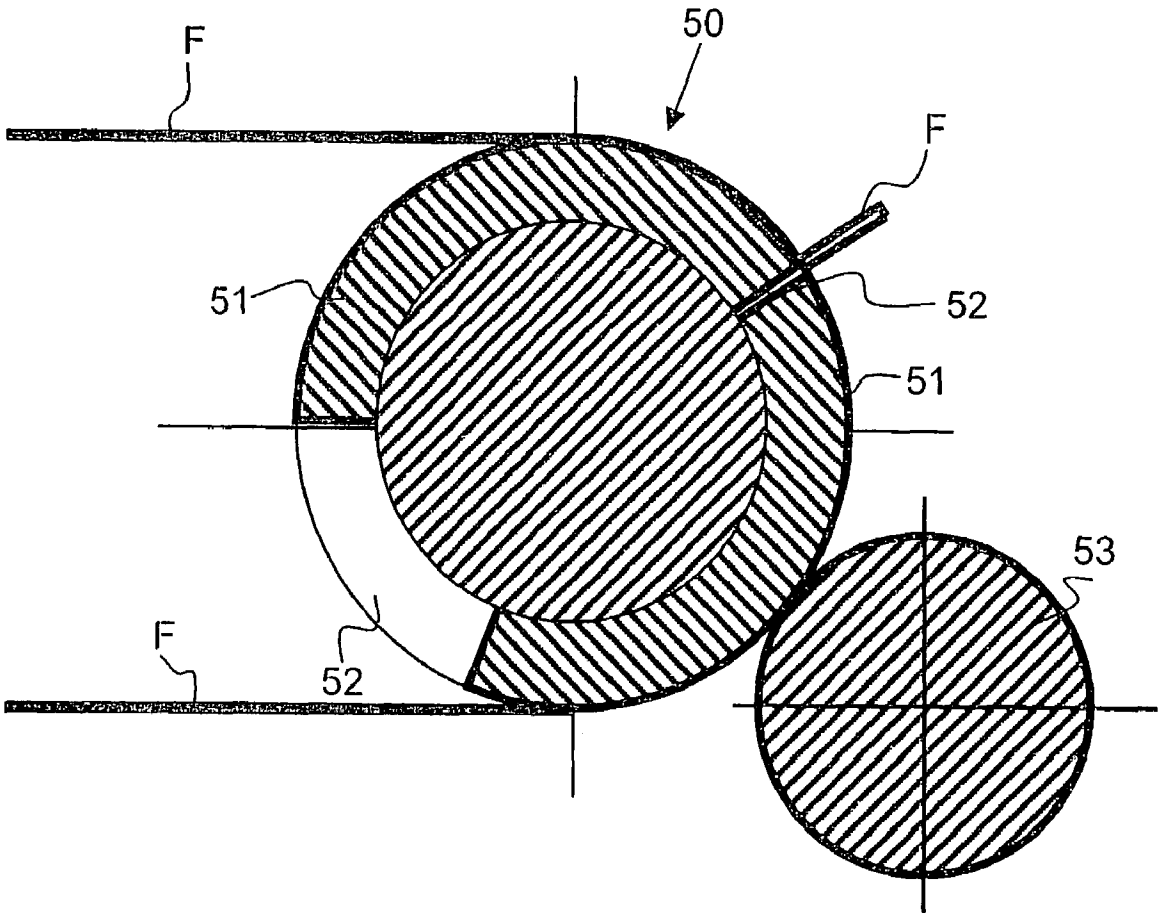
FIG. 9*b*, the detail of FIG. 9*a* in a second method step.

In a first variant shown in FIGS. 9*a* and 9*b*, it has a folding roller 50, which has two separately movable peripheral segments 51. The two peripheral segments 51 can be guided counter to one another in the tangential direction, as represented by arrows in FIG. 9*a*. In the process, the interstice 52 between the two peripheral segments 51 decreases in size. The packaging material F, which is guided via this roller 50, is everted outward when these segments move together, as can be seen from FIG. 9*b*. If the folding roller 50 is rotated onward, then the region of the packaging material F that protrudes from the roller 50 gets into the region of the sealing roller 53 or sealing jaw contacting the roller 50, and the releasable seals can be made at the desired points. The protruding part can be perforated or cut at a desired point by the sealing roller 53 or a preceding or following cutting device. The packaging material F may already be in a form that has perforations made at constant spacings. This apparatus is suitable for producing the packages of FIGS. 1 and 7.

Figure 10A:
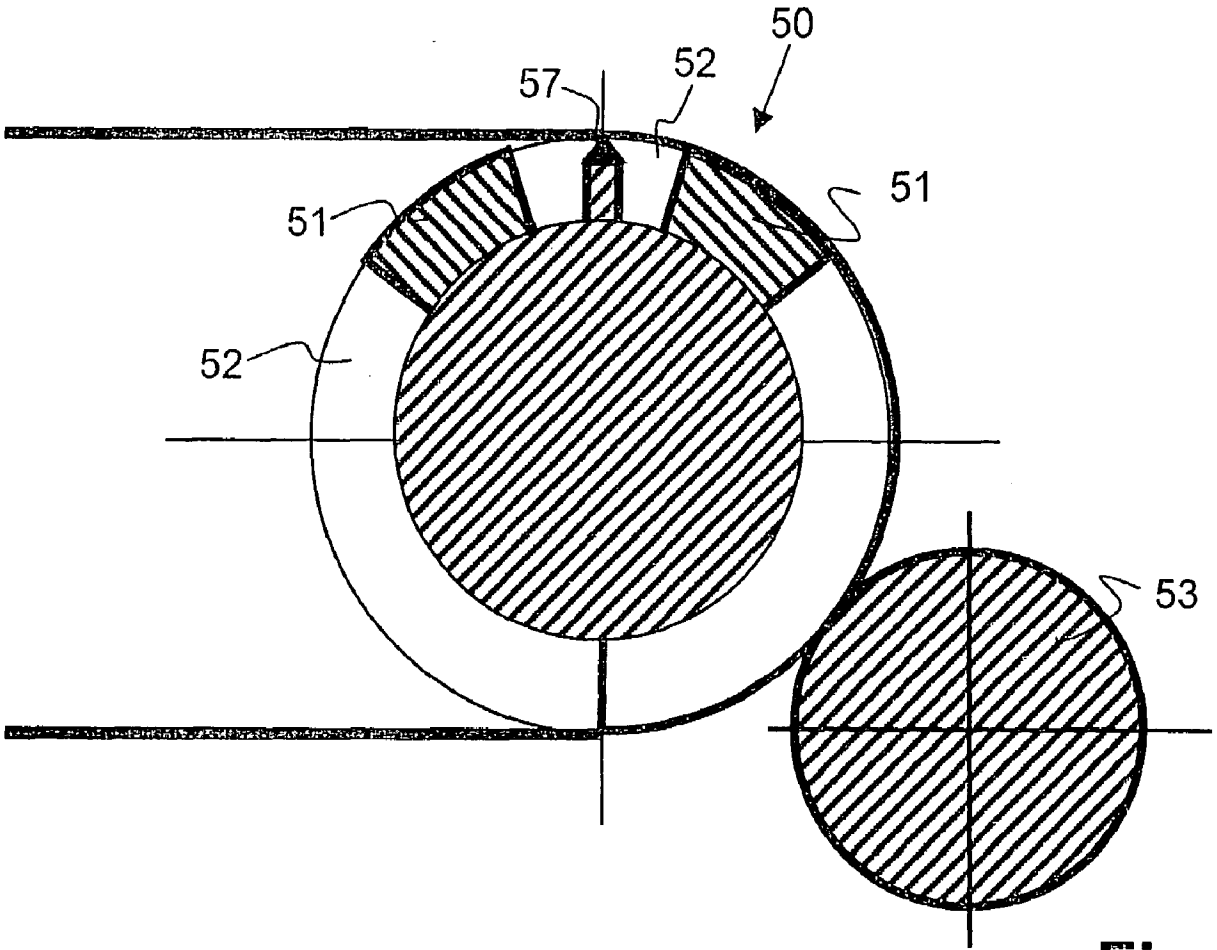
FIG. 10*a*, a detail of the tear-open assistance unit of FIG. 8, in a second variant in a first method step.
Figure 10B:
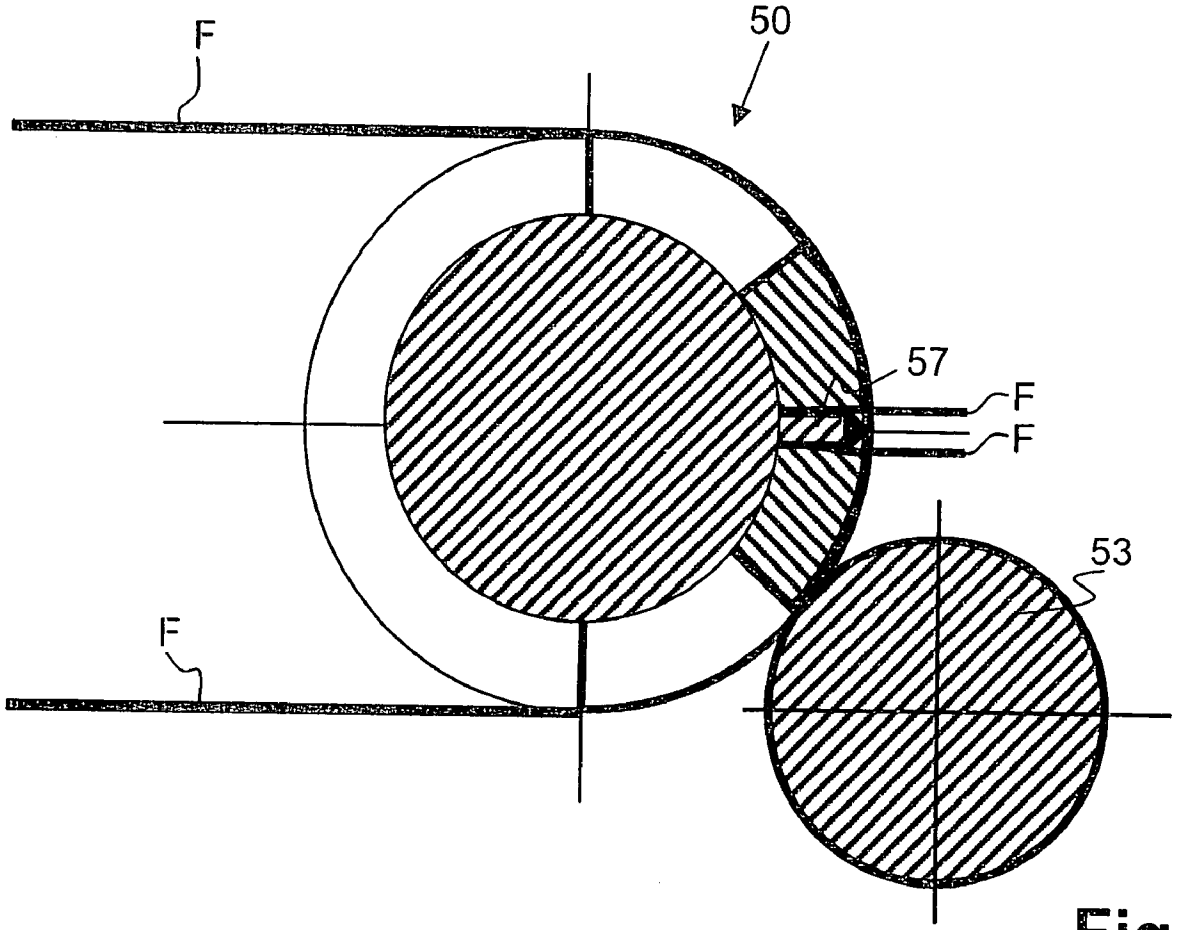
FIG. 10*b*, the detail of FIG. 10*a* in a second method step.

In the variant of FIGS. 10*a* and 10*b*, the folding roller 50 again has the two movable peripheral segments 51. In the interstice 52, a cutting and/or perforating device 57 is now provided, for cutting or perforating the packaging material at a desired point. This apparatus is suitable for producing the packages of FIGS. 1 and 7.

In FIGS. 11*a* through 11*d*, a further variant is shown; the individual drawings represent successive method steps. Here there are three rollers 54, 55, 56, between which the length of packaging material F extends. In FIG. 11*a*, the three rollers 54, 55, 56 are first driven at the same rotary speed. The second roller 55 is not involved in transporting the length of packaging material, since it is located at some spacing, preferably approximately 0.1 mm, from the length of packaging material F guided on the first roller 54 and thus does not contact the packaging material. The first and third rollers 54, 56 transport the length of packaging material F thanks to the imposition of a vacuum or by other known means. The imposition of a vacuum is represented in subsequent drawings by arrows. In the next step in FIG. 11*b*, the second roller 55, as before, is still not involved in transporting anything. However, the first roller 54 rotates at a higher speed than the third roller 56, so that a fold is formed in the length of packaging material F. In FIG. 11*c*, all the rollers 54, 55, 56 now run at the same rotary speed, and the second roller 55 is now involved in transporting the packaging material. In this involvement region, it has cutting and/or perforating means 57. In FIG. 11*d*, the cut made by the second roller 55 in the packaging material F can be seen. Also here, the vacuum in the second roller 55 is increased compared to that in the first roller 54. If other means for putting the packaging material in contact with the rollers are used, then the applicable attraction force of the second roller 55 is increased compared to that of the first roller 54. As a result, as can be seen from FIG. 11*e*, the packaging material is now pulled toward the second roller 55. Thanks to the spacing between the first and second rollers 54, 55, the first roller 54 can now form the next fold. In FIG. 1 if, it can be seen how the first fold is transported onward, thanks to the second and third rollers 55, 56, which now run at the same speed; in the region adjacent to the first roller 54, the second roller 55 no longer has any vacuum. This apparatus is suitable for producing the packages of FIGS. 1 and 7.

Figure 12:
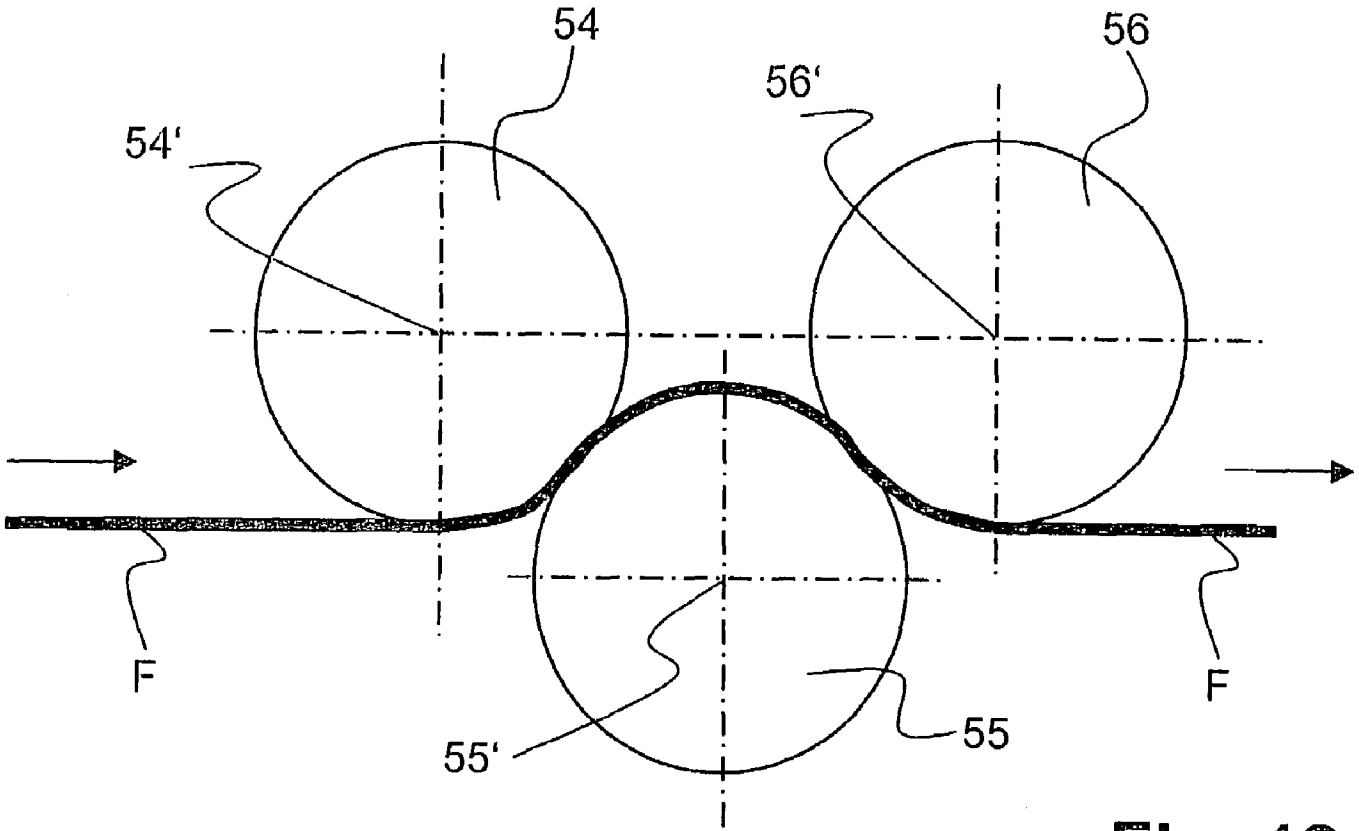
FIG. 12, a detail of the tear-open assistance unit of FIG. 8 in a fourth variant.

In the variant of FIG. 12, a different arrangement of the above-described three rollers 54, 55, 56 is shown. The axes of rotation 54', 55', 56' of the rollers 54, 55, 56 in FIGS. 11*a* through 11*d* are arranged in an equilateral triangle, and the delivery of packaging material F is done parallel to a side of the triangle that is formed by the first and second rollers 54, 55. Carrying the packaging material F away is done perpendicularly to this. In the arrangement shown in FIG. 12, the axes of rotation 54', 55', 56' form an isosceles triangle, and the packaging material F is delivered and carried away parallel to the side of the triangle that is formed by the axes of the first and third rollers 54, 56. This arrangement has the advantage that the directions of delivering and carrying away the packaging material F are aligned.

Figure 13:
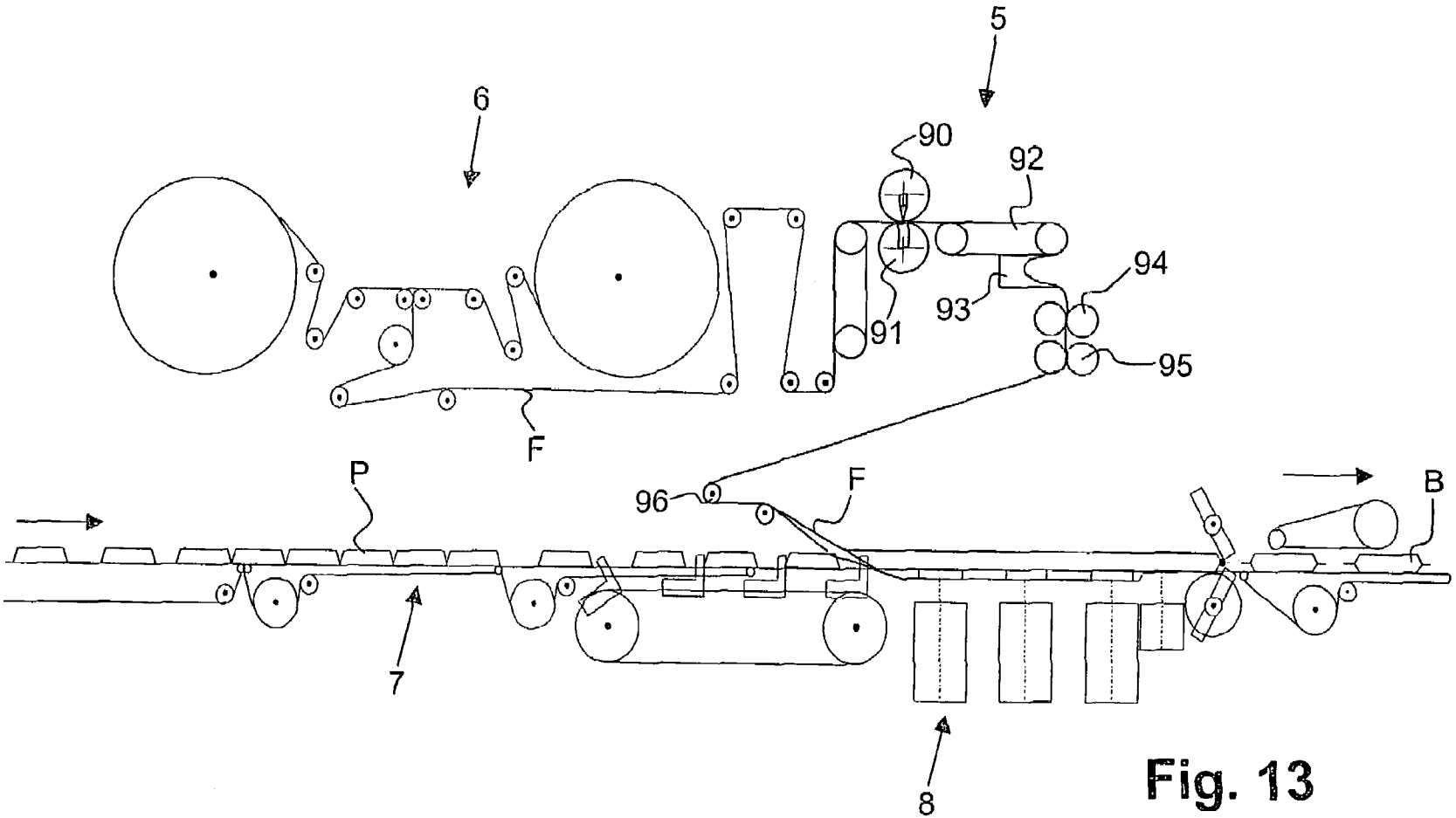
FIG. 13, a basic sketch of a packaging machine in a second embodiment.

In FIG. 13, a further preferred apparatus for producing such bag packages is shown. Once again, this is a bag package packaging machine of a known type, in particular a horizontal bag package packaging machine, which for forming the tearing aid is provided with a tear-open assistance unit 5 of the invention.

In this tear-open assistance unit 5, the perforating means 90, 91 precede the means 94, 95 for furnishing the overlap of material in the conveying direction of the film F. As the perforating means 90, a cutting roller 90 and a counterpressure roller 91 can for instance be used. Adjoining these rollers 90, 91, the perforated packaging film F is conveyed along a vacuum belt 92 and reaches a packaging material reservoir 93. This packaging material reservoir 93 is optional. Adjacent to the packaging material reservoir 93, two roller pairs 94, 95, located one after the other in the conveying direction, follow, and the overlap of material is produced and fixed between them. The film thus provided with overlapping regions is guided via deflection rollers 96 to the folding, sealing, and separating unit.

Figure 14A:
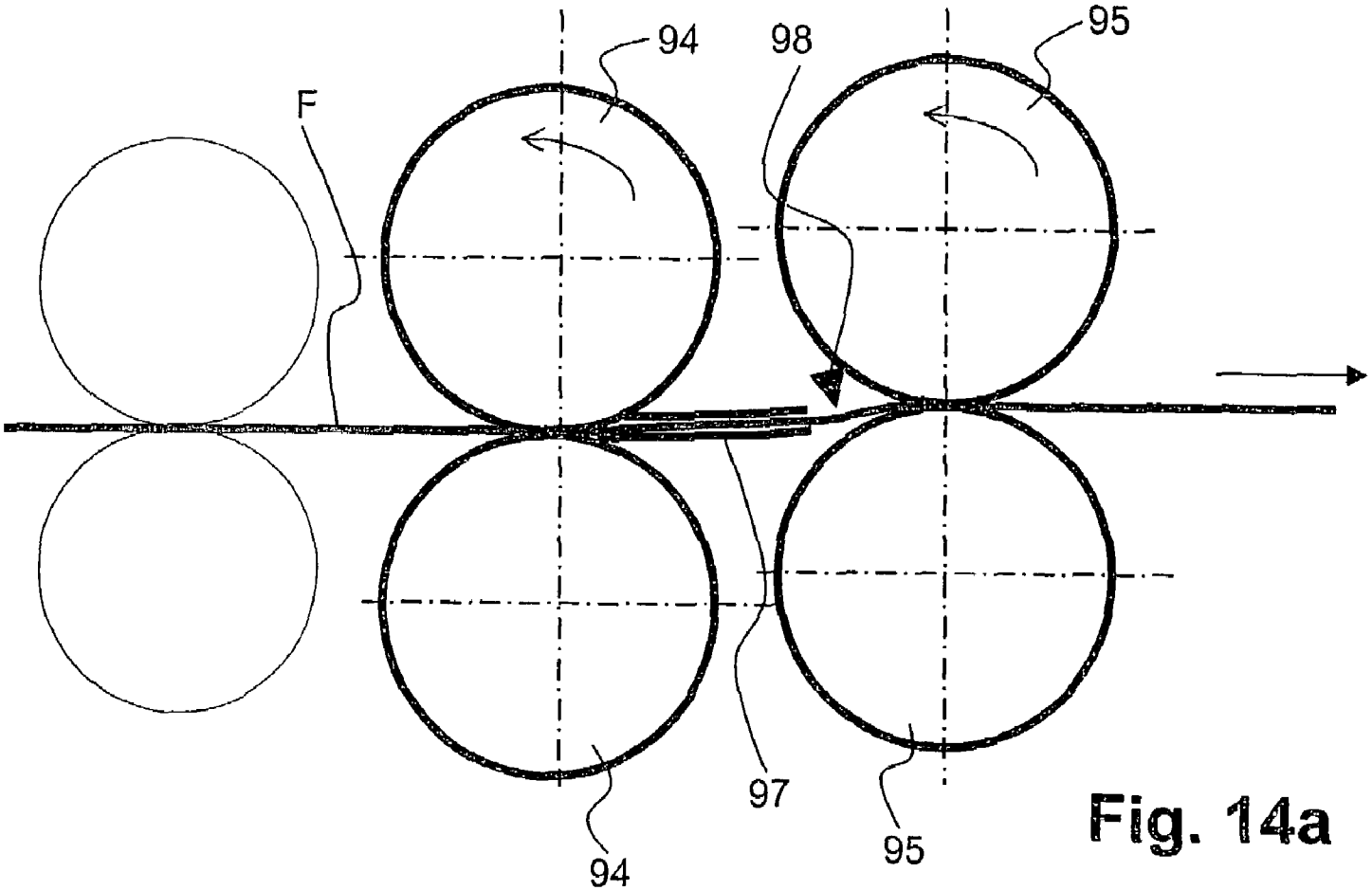
FIGS. 14*a* through 14*c*, a detail of the integrated tear-open assistance unit of the invention in FIG. 13.
Figure 14B:
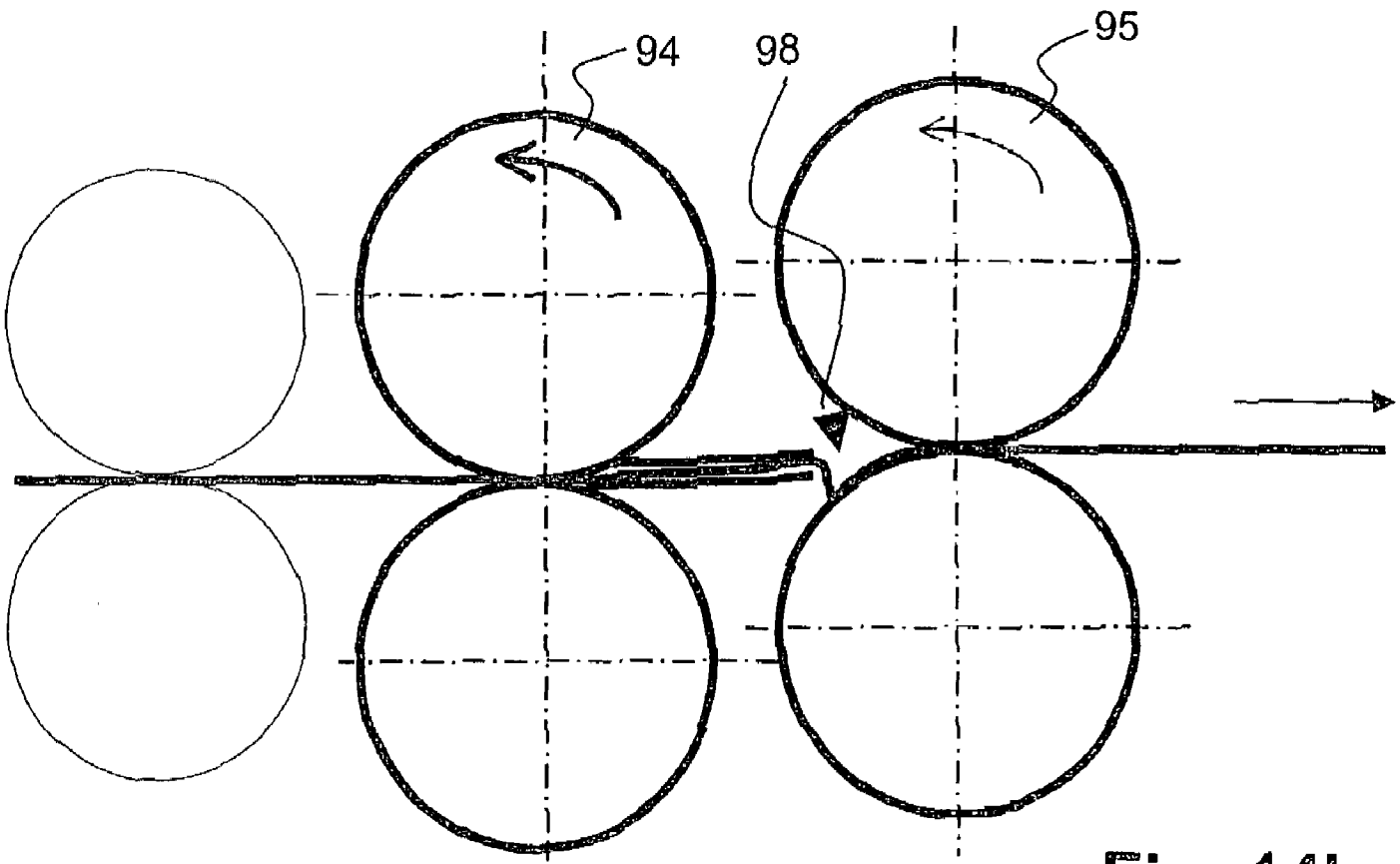
Figure 14C:
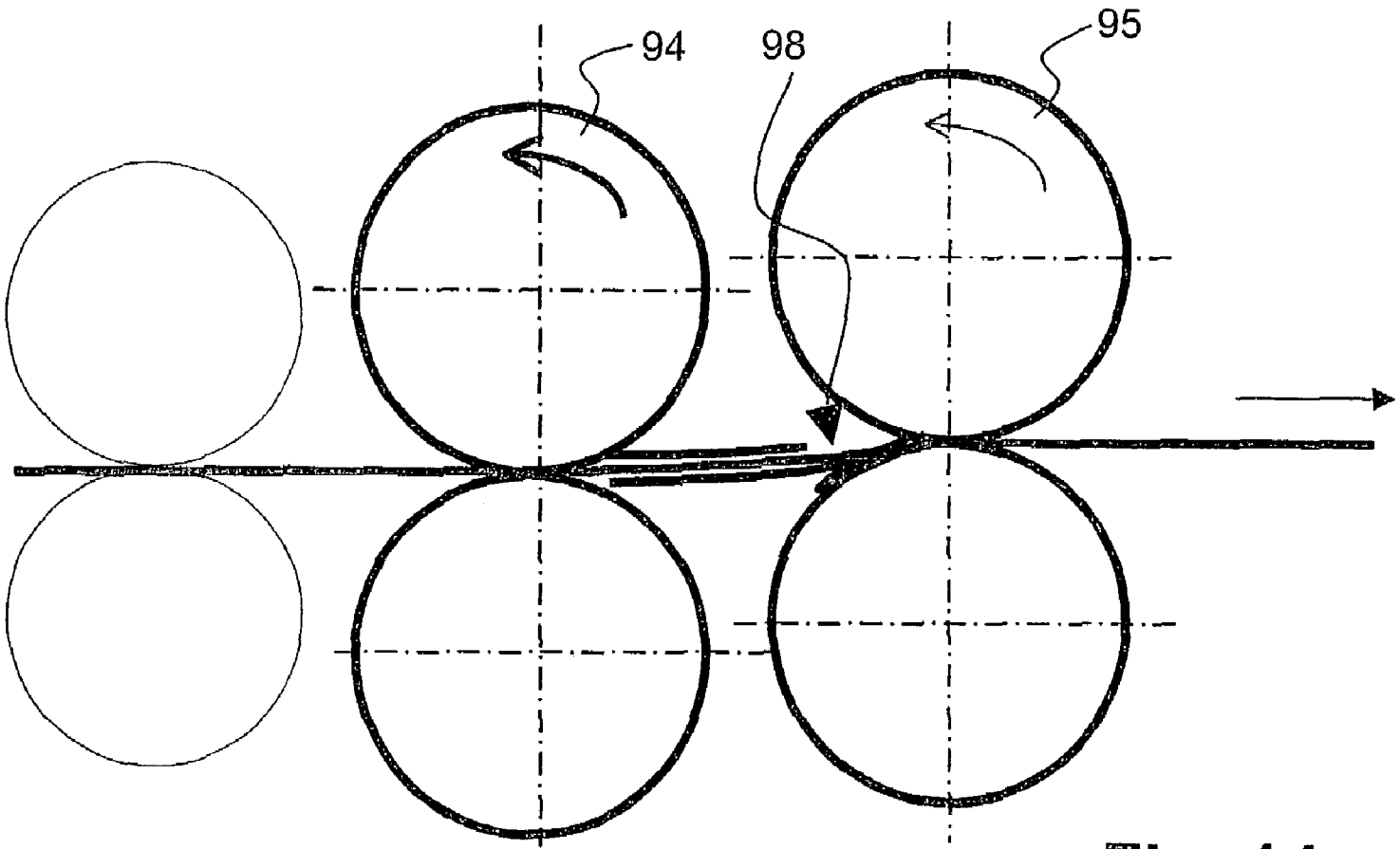

In FIGS. 14*a* through 14*c*, the roller pairs 94, 95 are shown. Thin lines symbolically also show the perforation means, in the form of two opposed rollers. The film F is first passed between the first roller pair 94. Between the two roller pairs 94, 95, there is a means for intentionally subjecting the film F to force. The force imposition by this means is represented by a triangle in the drawing and identified by reference numeral 98. The apex of the triangle pointing toward the film F is intended to indicate the direction of force imposition. As such means, air jets that blow at the film F can for instance be used. However, this means may also be a suction device that subjects the film to a vacuum. It is understood that still other means known in the prior art for deflecting the film F can also be used. To assure that the film F is not deflected until just before the second pair of rollers 95, it preferably, adjoining the first pair of rollers 94, extends in a guide 97. This guide 97 can be formed for instance by two parallel baffles such as metal or plastic plates, which limit the travel of the film F from above and below.

As can be in FIG. 14*a* from the arrows of equal size, first both pairs of rollers rotate at the same rotary speed. If the rotary speed of the first roller pair 94 is then increased relative to the second roller pair 95, as is represented in FIG. 14*b* by the arrows of different sizes, then the film F becomes backed up upstream of the second pair of rollers 95 and is purposefully deflected by the force imposition 98. The force imposition preferably takes place only purposefully along with the increase in the rotary speed, so that the film regions between two overlap of materials are not subjected to force on passing through this point. It can then be seen in FIG. 14*c* that because of the different speeds of the two pairs of rollers 94, 95, an overlap of material has now developed in the region of the perforation of the film F. This overlap can now be transported through the second pair of rollers 95 and fixed in its position either on passing through this pair of rollers 95 or just after that, in the manner already described above.

As can be seen from the various examples, the package or bag according to the invention can be produced from a flexible material and has an opening mechanism with a seal that is suitable for separating, by pulling off one segment or part of the bag from the rest of the bag, here called the main body. This part of the bag is joined to the rest by a nonpermanent seal, which detaches in response to a corresponding tensile or compressive stress, and as a result, one part of the bag can be separated from the rest. The detachable part of the bag package can be selected to be of arbitrary size. Cold glue is especially suitable as a nonpermanent seal. In some of the exemplary embodiments, the part of the bag that can be pulled off from the rest is partly everted around itself and is joined in this region to the rest via a nonpermanent, detachable seal. One part thus protrudes into the other and can be pulled out. Hence there are three layers of material in this region. When a pull is exerted on one or both ends of the bag, the film sealed on the inside against the main body is progressively released and rolls in the direction of the tension. On arriving at the end, the pulled-off bag segment detaches, and the bag is completely and cleanly open.

It is understood that the package according to the invention and the apparatus according to the invention can be modified in manifold ways without departing from the concept of the invention. In particular, the tearing aid 3 can be cut or perforated either before or after the detachable sealing seam is applied. Instead of a detachable seal, some other detachable type of connection can be used, in particular an adhesive bond. The sealing can be done by known means. In particular, it can be cold or hot sealing. An already preperforated film can also be used, so that in this case perforating means integrated into the tear-open unit 5 are unnecessary.

The foregoing relates to a preferred exemplary embodiment of the invention, it being understood that other variants and embodiments thereof are possible within the spirit and scope of the invention, the latter being defined by the appended claims.

LIST OF REFERENCE NUMERALS

1 Package
10 First package region
11 Second package region
2 Transverse sealing seams
3 Tearing aid
30 Overlapping region
31 Packaging material fold
32 Packaging material edge region
33 Detachable sealing seam
35 First edge
36 Second edge
37 Strip
38 Perforation line
5 Tear-open assistance unit
50 Folding roller
51 Peripheral segment
52 Interstice
53 Sealing roller
54 First roller
54' First axis of rotation
55 Second roller
55' Second axis of rotation
56 Third roller
56' Third axis of rotation
57 Cutting or perforating means
6 Packaging material delivery unit
7 Product delivery unit
8 Folding, sealing, and separating unit
90 Cutting roller
91 Counterpressure roller
92 Vacuum belt
93 Packaging material reservoir
94 First roller pair
95 Second roller pair
96 Deflection roller
97 Guide
98 Imposition of force
P Product
F Packaging material
B Bag

The invention claimed is:

1. A method for producing a bag package formed of a packaging material having two transverse sealing seams and one longitudinal sealing seam and one separation region that serves for tearing open the bag package for the sake of at least partly exposing a product packaged in it, and which separation region is provided with a cutting or perforating line, the improvement wherein the separation region extends spaced apart from and approximately parallel to at least one of the transverse sealing seams and extends around approximately the entire circumference of the bag package; and wherein the separation region has a releasably fixed overlap of material of the packaging material extending over approximately the entire circumference, the method including delivering a bandlike packaging material and products to be packaged to a folding, sealing, and separating or perforating unit along a conveying direction, and placing the products on the packaging material at the folding, sealing and separating or perforating unit, folding the packaging material into a tube, providing the tube with sealing seams in the directions transverse and parallel to the conveying direction of the packaging material, and providing the bag package, in its production, with a tearing aid in conjunction with the separation region, the improvement wherein, before the packaging material is folded into a tube, the packaging material is either separated or perforated and overlapped in the separation region, this overlap of material extending at least approximately transversely to the conveying direction of the packaging material, and wherein the overlap of material is detachably fixed in the separation region to the material which it overlaps to form the tearing aid.

2. The method as defined by claim 1, wherein before the overlapping of the packaging material, the packaging material is separated or perforated in the separation region at least approximately perpendicular to the conveying direction of the packaging material.

3. The method as defined by claim 1, wherein the packaging material is passed between two roller pairs, and one roller pair is rotated at a higher rotational speed than the other roller pair in order to form the overlap of material.

4. The method as defined by claim 2, wherein the packaging material is passed between two roller pairs, and one roller pair is rotated at a higher rotational speed than the other roller pair in order to form the overlap of material.

5. A method for producing a bag package formed of a packaging material having two transverse sealing seams and one longitudinal sealing seam and one separation region that serves for tearing open the bag package for the sake of at least partly exposing a product packaged in it and is provided with a cutting or perforating line, the improvement wherein the separation region extends spaced apart from and approximately parallel to at least one of the transverse sealing seams and extends around approximately the entire circumference of the bag package; and wherein the separation region has a releasably fixed overlap of material of the packaging material extending over approximately the entire circumference, the method including delivering a bandlike packaging material and products to be packaged to a folding, sealing, and separating unit along a conveying direction, and placing the products on the packaging material at the folding, sealing and separating unit, folding the packaging material into a tube, providing the tube with sealing seams in the directions transverse and parallel to the conveying direction of the packaging material, and providing the bag package, in its production, with a tearing aid in conjunction with a separation region, the improvement wherein, before the packaging material is folded into a tube, the packaging material is separated and overlapped in the separation region, this overlap of material extending at least approximately transversely to the conveying direction of the packaging material, and wherein the overlap of material is detachably fixed in the separation region to the material which it overlaps to form the tearing aid.

6. The method as defined by claim 5, wherein before the overlapping of the packaging material, the packaging material is separated in the separation region at least approximately perpendicular to the conveying direction of the packaging material.

7. The method as defined by claim 5, wherein the packaging material is passed between two roller pairs, and one roller pair is rotated at a higher rotational speed than the other roller pair in order to form the overlap of material.

8. The method as defined by claim 6, wherein the packaging material is passed between two roller pairs, and one roller pair is rotated at a higher rotational speed than the other roller pair in order to form the overlap of material.

* * * * *